United States Patent [19]

Jacobson et al.

[11] 4,436,653

[45] Mar. 13, 1984

[54] STABLE LIQUID DETERGENT COMPOSITIONS

[75] Inventors: Ronald L. Jacobson, Wyoming; Dean C. Hanley, Cincinnati, both of Ohio

[73] Assignee: The Procter & Gamble Company, Cincinnati, Ohio

[21] Appl. No.: 359,557

[22] Filed: Mar. 18, 1982

Related U.S. Application Data

[63] Continuation-in-part of Ser. No. 251,650, Apr. 6, 1981, abandoned.

[51] Int. Cl.[3] ..... C11D 1/44

[52] U.S. Cl. ..... 252/547; 252/544; 252/545; 252/531; 252/174.21; 252/174.22; 252/DIG. 1; 252/DIG. 14

[58] Field of Search ..... 252/DIG. 14, DIG. 1, 252/545, 551, 532, 174.21, 547, 531, 544, 174.22

[56] References Cited

U.S. PATENT DOCUMENTS

| | | | |
|---|---|---|---|
| 3,281,368 | 10/1966 | Zimmerer et al. | 252/137 |
| 3,341,459 | 9/1967 | Davis | 252/137 |
| 3,351,557 | 11/1967 | Almstead | 252/106 |
| 3,717,630 | 2/1979 | Booth | 260/240 CA |
| 3,755,206 | 8/1973 | Verdier | 252/545 |
| 3,793,233 | 2/1974 | Rose et al. | 252/DIG. 14 |
| 3,812,041 | 5/1974 | Inamorato | 252/DIG. 14 |
| 3,914,185 | 10/1975 | Inamorato | 252/546 |
| 3,928,249 | 12/1975 | Nunziata et al. | 252/526 |
| 3,953,380 | 4/1976 | Sundby | 252/543 |
| 3,954,675 | 5/1976 | Inamorato et al. | 252/DIG. 1 |
| 3,963,649 | 6/1976 | Spadini | 252/546 |
| 4,092,272 | 5/1978 | Nishimura | 252/545 |
| 4,247,424 | 1/1981 | Kuzel | 252/528 |
| 4,259,216 | 3/1981 | Miyajima | 252/545 |
| 4,284,532 | 8/1981 | Leikhim | 252/528 |
| 4,304,680 | 12/1981 | Wixon | 252/DIG. 14 |
| 4,316,824 | 2/1982 | Pancheri | 252/DIG. 14 |

FOREIGN PATENT DOCUMENTS

| | | |
|---|---|---|
| 948396 | 2/1964 | United Kingdom . |
| 951930 | 3/1964 | United Kingdom . |
| 1458783 | 12/1976 | United Kingdom . |

OTHER PUBLICATIONS

Pending U.S. Patent Application Ser. No. 254,685, Gajewski et al., filed Apr. 16, 1981.

*Primary Examiner*—John E. Kittle
*Assistant Examiner*—Hoa Van Le
*Attorney, Agent, or Firm*—Donald E. Hasse; Robert B. Aylor; Thomas H. O'Flaherty

[57] ABSTRACT

Stable liquid detergent compositions containing nonionic, amine oxide and alcohol polyethoxylate sulfate surfactants and a water-soluble detergency builder are disclosed. The compositions are single phase isotropic liquids which exhibit improved freeze-thaw stability. The polyethoxylate sulfate surfactant enhances detergency performance on textiles that have been softened with a conventional cationic fabric softener.

15 Claims, No Drawings

STABLE LIQUID DETERGENT COMPOSITIONS

REFERENCE TO RELATED APPLICATION

This application is a continuation-in-part of U.S. patent application Ser. No. 251,650, filed Apr. 6, 1981 now abandoned.

BACKGROUND OF THE INVENTION

This invention relates to stable liquid detergent compositions having supreior detergent properties.

There has been considerable demand for liquid detergent compositions which provide superior detergency under a wide variety of conditions including cool water conditions. In order to obtain superior detergency under a wide variety of conditions, a number of components are needed. The formulation of stable liquid detergent compositions is difficult when the components tend to separate into discrete phases.

U.S. Pat. No. 4,247,424, Kuzel et al, issued Jan. 27, 1981, discloses liquid detergent compositions in the form of water-in-oil emulsions which contain ethoxylated alcohol and amine oxide surfactants.

U.S. Pat. No. 4,284,532, Leikhim et al, issued Aug. 18, 1981, discloses liquid detergent compositions in isotropic form which contain ethoxylated alcohol and amine oxide surfactants.

U.S. Pat. No. 4,276,205, Ferry, issued June 30, 1981, discloses detergent compositions containing ethoxylated alcohol and amine oxide surfactants plus a polyalkylene glycol detergency improver such as polyethylene glycol.

SUMMARY OF THE INVENTION

The present invention encompasses a stable liquid detergent composition comprising:

(a) from about 3% to about 20% of an ethoxylated alcohol or ethoxylated alkyl phenol nonionic surfactant of the formula $R(OC_2H_4)_nOH$, wherein R is selected from the group consisting of aliphatic hydrocarbon radicals containing from about 8 to about 15 carbon atoms and alkyl phenyl radicals in which the alkyl group contains from about 8 to about 12 carbon atoms, n is from about 3 to about 9, and said nonionic surfactant has an HLB value of from about 10 to about 13;

(b) from about 2% to about 15% of an amine oxide surfactant having the formula

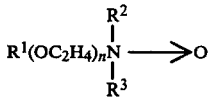

wherein $R^1$ is an alkyl, hydroxyalkyl, alkoxyhydroxypropyl, alkoxyhydroxyethyl, alkyl amido or alkyl carboxylate radical in which the alkyl and alkoxy portions contain from about 8 to about 18 carbon atoms, $R^2$ and $R^3$ are selected from methyl, ethyl, propyl, isopropyl, 2-hydroxyethyl, 2-hydroxypropyl, 3-hydroxypropyl, or said groups joined together to form a cyclic structure in which the nitrogen is part of a heterocyclic ring, and n is from 0 to about 10;

(c) from about 1% to about 10% of an alcohol polyethoxylate sulfate surfactant having the formula $R^4O(C_2H_4O)_mSO_3M$, wherein $R^4$ is an alkyl or hydroxyalkyl radical containing from about 10 to about 18 carbon atoms, m is from about 2 to about 10 and M is a compatible cation;

(d) from about 5% to about 25% of a water-soluble polycarboxylate, polyphosphonate or polyphosphate detergency builder capable of sequestering calcium and magnesium ions in water solution; provided that components (a), (b), (c) and (d) together represent less than about 40% by weight of the composition;

(e) from 0% to about 25% of a hydrotrope;

(f) up to about 89% water; said liquid detergent composition being in isotropic form and having a pH of from about 8 to about 13 in a 0.2% water solution at 20° C.

DETAILED DESCRIPTION OF THE INVENTION

The liquid detergent compositions herein comprise five essential ingredients:

(a) ethoxylated nonionic surfactant;
(b) amine oxide surfactant;
(c) alcohol polyethoxylate sulfate surfactant;
(d) water-soluble detergency builder; and
(e) water.

The compositions of the invention are single phase isotropic liquids which exhibit improved stability in that they return, or substantially return, to a single isotropic phase after freezing and thawing. The nonionic, amine oxide and polyethoxylate sulfate surfactants and the builders herein together repesent less than about 40% by weight of the composition. Compositions containing more than about 40% by weight of such components tend to separate into a surfactant-rich sope phase and a salt-rich lye phase after freezing and thawing. Preferred compositions herein contain less than about 34%, and most preferably less than about 28%, by weight of such components, and exhibit even greater stability in that they return to single phase isotropic liquids after being slowly frozen (e.g., over a period of days) and thawed. The compositions, particularly those with higher surfactant and builder levels within the above limits, also preferably contain the optional hydrotropes herein which help to solubilize the surfactants and salts in the water phase under a wide variety of conditions.

Ethoxylated Nonionic Surfactant

The compositions of the present invention contain from about 3% to about 20% by weight of an ethoxylated nonionic surfactant of the formula $R(OC_2H_4)_nOH$, wherein R is selected from the group consisting of aliphatic hydrocarbon radicals containing from about 8 to about 15 carbon atoms and alkyl phenyl radicals in which the alkyl group contains from about 8 to about 12 carbon atoms, n is from about 3 to about 9, and said nonionic surfactant has an HLB value of from about 10 to about 13.

Suitable ethoxylated nonionic surfactants are the condensation products of alkyl phenols having an alkyl group containing from about 8 to about 15 carbon atoms, in either a straight chain or branched chain configuration, with ethylene oxide, the ethylene oxide being present in amounts equal to from about 3 to about 9 moles of ethylene oxide per mole of alkyl phenol. The alkyl substituent in such compounds can be derived, for example, from polymerized propylene or isobutylene, or from octene or nonene. Examples of compounds of this type include nonyl phenol condensed with about 8 moles of ethylene oxide per mole of nonyl phenol and dodecyl phenol condensed with about 9 moles of ethylene oxide per mole of dodecyl phenol. Commercially available nonionic surfactants of this type include Igepal CO-530, CO-610, CO-630, CA-520, CA-620, and CA-630, marketed by the GAF Corporation.

Other useful nonionic surfactants herein are condensation products of primary or secondary aliphatic alcohols with from about 3 to about 9 moles of ethylene oxide per mole of alcohol. The alkyl chain of the aliphatic alcohol can either be straight or branched and contains from about 8 to about 15 carbon atoms. Examples of such ethoxylated alcohols include the condensation product of about 5 moles of ethylene oxide with 1 mole of tridecanol, myristyl alcohol condensed with about 8 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with coconut alcohol. Examples of commercially available nonionic surfactants of this type include Tergitol 15-S-7 marketed by the Union Carbide Corporation and Neodol 23-6.5 marketed by the Shell Chemical Company. Whether the alcohol is derived from natural fats or produced by one of several petrochemical processes, a mixture of carbon chain lengths is typical. The stated degree of ethoxylation is an average, the distribution being dependent on process conditions.

Ethoxylated alcohols are preferred because of their superior biodegradability relative to ethoxylated alkyl phenols. Particularly preferred are ethoxylated alcohols having an average of from about 10 to about 15 carbon atoms in the alcohol and an average degree of ethoxylation of from about 3 to about 8 moles of ethylene oxide per mole of alcohol.

The cloud point of a 1% aqueous solution of the ethoxylated nonionic surfactant is preferably below about 75° C. and most preferably below about 55° C.

The preferred ethoxylated nonionic surfactants will have HLB (hydrophile-lipophile balance) values of from about 10 to about 13 and limited water solubility. The HLB value of surfactants and emulsifiers can be determined experimentally in a well-known fashion. The HLB value of compounds or mixtures of compounds in which the hydrophilic portion of the molecule is principally ethylene oxide can be estimated by the weight ratio of ethylene oxide portion to the lipophilic portion (e.g., the hydrocarbyl radical).

A preferred level of ethoxylated nonionic surfactants in the compositions of the invention is from about 5% to about 10%.

Optional ethoxylated nonionic surfactants include: (1) the condensation products of ethylene oxide with a hydrophobic base formed by the condensation of propylene oxide and propylene glycol, and (2) the condensation products of ethylene oxide with the product resulting from the reaction of propylene oxide and ethylenediamine. These surfactants are marketed by BASF Wyandotte under the tradenames Pluronic and Tetronic respectively.

Amine Oxide Surfactant

The compositions of the present invention also contain from about 2% to about 15% by weight of an amine oxide surfactant having the formula

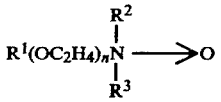

wherein $R^1$ is an alkyl, hydroxyalkyl, alkoxyhydroxypropyl, alkoxyhydroxyethyl, alkyl amido or akyl carboxylate radical in which the alkyl and alkoxy, respectively, contain from about 8 to about 18 carbon atoms, $R^2$ and $R^3$ are methyl, ethyl, propyl, isopropyl, 2-hydroxyethyl, 2-hydroxypropyl, 3-hydroxypropyl, or together are a heterocyclic, e.g., morpholino, structure in which the nitrogen is part of the heterocyclic ring, and n is from 0 to about 10.

Specific examples of amine oxide surfactants include: dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis(2-hydroxyethyl)-3-dodecoxy-2-hydroxypropylamine oxide, (2-hydroxypropyl)methyltetradecylamine oxide, dimethyloleylamine oxide, dimethyl(2-hydroxydodecyl)amine oxide, $C_{8-20}$ alkyl alpha-dimethylamine oxide carboxylates, and the corresponding decyl, hexadecyl and octadecyl homologs of the above compounds. A particularly preferred material is $C_{12-16}$ alkyl dimethylamine oxide.

A preferred level of amine oxide surfactant in the compositions of the invention is from about 3% to about 10%. Preferred weight ratios of ethoxylated nonionic surfactant to amine oxide surfactant are from about 1:1 to about 4:1, more preferably from about 1.5:1 to 3:1.

The Alcohol Polyethoxylate Sulfate Surfactant

The present compositions contain from about 1% to about 10%, preferably from about 2% to about 6%, by weight of an alcohol polyethoxylate sulfate surfactant and of the formula $R^4O(C_2H_4O)_mSO_3M$, wherein $R^4$ is an alkyl (preferred) or hydroxyalkyl radical containing from about 10 to about 18 carbon atoms, m is from about 2 to about 10 and M is a compatible cation.

The alcohol polyethoxylate sulfate surfactant is essential to the overall performance and stability of the present compositons. It has been found that if only the nonionic and amine oxide surfactants are present, fabrics which are regularly softened with conventional cationic fabric softening ingredients such as ditallowdimethylammonium chloride will gradually become objectionably yellow. The reason for this effect is unclear, but in any event it can be controlled by the addition of an anionic surfactant to the compositions. Surprisingly, of the anionic surfactants tested, only the alcohol polyethoxylate sulfates can be added to the compositions in sufficient quantity to provide the desired effect without forming a separating phase or requiring the use of uneconomical amounts of compatibilizing materials.

The specific alcohol polyethoxylate sulfate surfactants require at least about two ethoxy groups per molecule on the average to keep the composition single phase. Preferably the degree of ethoxylation is from about two to about three.

Preferred alcohol polyethoxylate sulfate surfactants are $C_{12-15}$ alkyl polyethoxylate (2.2) sulfate ($C_{12-15}$ $E_{2.2}S$); $C_{14-15}E_{2.2}S$; $C_{12-13}E_3S$; $C_{16-18}E_5S$; $C_{14-15}E_3S$; and mixtures thereof. The sodium, potassium, and monoethanolammonium salts, and mixtures thereof, are preferred.

Soap

A desirable and preferred additional ingredient is a $C_{10-18}$ fatty acid soap having the same cation or cations as the other anionic materials due to ion exchange. This ingredient, at a level of from about 0.2% to about 5%, preferably from about 0.5% to about 1%, provides corrosion protection, suds control, and additional cleaning potential. Coconut and unsaturated $C_{16-18}$ soaps such as oleyl are preferred for solubility reasons.

Water-Soluble Detergency Builder

The compositions herein also contain from about 5% to about 25%, preferably from about 10% to about 20%, by weight of a water-soluble polycarboxylate, polyphosphonate, or polyphosphate detergency builder capable of sequestering calcium or magnesium ions in water solution.

The essential detergency builders of the present invention have the ability to sequester calcium or magnesium ions in water solution, and also maintain or assist in maintaining an alkaline pH in a washing solution. Sequestration is the formation of coordination complexes with metallic ions to prevent or inhibit precipitation or other interfering reactions. The phenomenon is also called chelation if certain structural criteria are met by the coordination complex.

Suitable polycarboxylate builders herein include the various aminopolycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates.

Examples of such polycarboxylate builders are sodium and potassium ethylenediaminetetraacetate: sodium and potassium nitrilotriacetate: the water-soluble salts of phytic acid, e.g., sodium and potassium phytates, disclosed in U.S. Pat. No. 2,739,942, Eckey, issued Mar. 27, 1956, incorporated herein by reference; the polycarboxylate materials described in U.S. Pat. No. 3,364,103, incorporated herein by reference; and the water-soluble salts of polycarboxylate polymers and copolymers described in U.S. Pat. No. 3,308,067, Diehl, issued Mar. 7, 1967, incorporated herein by reference.

Useful detergent builders include the water-soluble salts of polymeric aliphatic polycarboxylic acids having the following structural and physical characteristics: (a) a minimum molecular weight of about 350 calculated as to the acid form; (b) an equivalent weight of about 50 to about 80 calculated as to acid form; (3) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Other suitable polycarboxylate builders include the water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

Other polycarboxylates for use herein are the polyacetal carboxylates described in U.S. Pat. No. 4,144,226, issued Mar. 13, 1979 to Crutchfield et al, and U.S. Pat. No. 4,146,495, issued Mar. 27, 1979 to Crutchfield et al, the disclosures of which are incororated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution and converted to the corresponding salt.

Preferred polycarboxylate builders for use in the present invention are sodium and potassium nitrilotriacetate, sodium and potassium citrate, and mixtures thereof. Sodium nitrilotriacetate is particularly preferred.

Polyphosphonate builders useful herein are disclosed in U.S. Pat. No. 3,213,030, Diehl, issued Oct. 19, 1965, U.S. Pat. No. 3,433,021, Roy, issued Jan. 14, 1968, U.S. Pat. No. 3,292,121, Gedge, issued Jan. 9, 1969 and U.S. Pat. No. 2,599,807, Bersworth, issued June 10, 1952, all incorporated herein by reference. Preferred polyphosphonate builders are the sodium and potassium salts of ethylene diphosphonic acid, ethane 1-hydroxy-1,1-diphosphonic acid, and ethane-1,1,2-triphosphonic acid.

Preferred aminopolyphosphonate builders are the sodium and potassium salts of diethylenetriaminepentamethylenephosphonic acid, hexamethylenediaminetetramethylenephosphonic acid, diethylenediaminetetramethylenephosphonic acid, and nitrilotrimethylenephosphonic acid.

Polyphosphates useful herein include the water-soluble tripolyphosphates, pyrophosphates, and the polymeric metaphosphates having a degree of polymerization of from about 6 to 21. However, the tripolyphosphates and metaphosphates tend to hydrolyze to a mixture of orthophosphate and pyrophosphate with prolonged storage in aqueous solutions. Since the orthophosphates precipitate but do not sequester water-hardness ions, the pyrophosphates are the preferred polyphosphates for use in the present invention. Particularly preferred is potassium pyrophosphate since sodium pyrophosphate has a tendency to precipitate from concentrated solutions at low storage temperatures.

It is to be understood that while the alkali metal, and particularly the sodium and potassium, salts of the foregoing inorganic and organic detergency builder salts are preferred for use herein from economic and solubility standpoints, the ammonium, alkanolammonium, e.g., triethanolammonium, diethanolammonium, and the like, water-soluble salts of any of the foregoing builder anions are also useful herein.

Water

The compositions of this invention contain up to about 89% water, and preferably contain from about 35% to about 65% water.

Optional Hydrotrope

The liquid detergent compositions of this invention are stable and isotropic. Those containing lower levels of water are not necessarily true solutions. Many of the compositions herein appear to be microemulsions of an oil phase in water, the oil phase comprising inter alia the bulk of the ethoxylated nonionic surfactant.

The hydrotropes of the present invention are water soluble and preferably have an HLB value above about 14. Suitable hydrotropes have shorter alkyl chain lengths than the corresponding surfactants used as the principal surfactant in detergent compositions. For example, the soluble salts, particularly sodium and potassium salts, of toluene sulfonate, xylene sulfonate, and cumene sulfonate are preferred hydrophilic stabilizing agents in the practice of the invention; a $C_{11-15}$ alkylbenzene sulfonate typically used in household detergent compositions is not suitable. The cations are the same as or compatible with the anionic surfactants.

Phosphate esters, particularly those with a predominance of single alkyl groups and designated primary esters, can have the hydrophilic characteristics necessary to assist in the formation of an isotropic liquid detergent composition. Emphos PS-413 and PS-236 (Witco Chemical Company) and Gafac PE-510 (GAF Corporation) are commercially available phosphate materials suitable as the hydrotrope in the practice of the invention. Preferred phosphate esters will contain a high proportion of monoalkyl phosphate esters and can be of the type consisting of the condensation product of the reaction of $R(OC_2H_4)_xOH$ and a phosphoric or polyphosphoric acid, R being an alkyl or alkyl phenyl group, said alkyl containing from about 4 to about 18 carbon atoms and x being 0 to 20.

Ethoxylated nonionic surfactants with a relatively high degree of ethoxylation and a corresponding high HLB value can find use in the compositions of the present invention.

Mixtures of hydrotropes, especially mixtures of lower alkylbenzene sulfonates, such as toluene sulfonate, and phosphate esters, can be used, but preferably no phosphorus is present.

The types and levels of hydrotropes needed to produce an isotropic liquid detergent composition will be dependent on the type and level of other components, particularly the ethoxylated nonionic surfactant and its extent of water solubility. A preferred level of hydrotrope is from about 5% to about 16% by weight of the liquid detergent composition.

Other Optional Components

The following ingredients can be present, but desirably are not present, especially in substantial quantities. In some embodiments of the present invention the detergent compositions can contain up to about 10%, preferably to about 5%, of a fatty acid amide surfactant, such as ammonia amides, monoethanol amides, diethanol amides, and ethoxylated amides. Preferred amides are $C_{8-20}$ monoethanol amides, $C_{8-20}$ diethanol amides, and amides having the formula $$R-\overset{\overset{\displaystyle O}{\|}}{C}-\overset{\overset{\displaystyle H}{|}}{N}-CH_2CH_2OCH_2CH_2OH,$$

wherein R is a $C_{8-20}$ alkyl group, and mixtures thereof. Particularly preferred amides are those where the alkyl group contains from about 10 to about 16 carbon atoms, such as coconut alkyl monoethanol or diethanol amide. Such compounds are commercially available under the tradenames Super-Amide L-9 and GR, from Onyx Chemical Co., Jersey City, N.J., Super-Amide F-3 from Ryco, Inc., Conshohocken, Pa., and Gafamide CDD-518, available from GAF Corp., New York, N.Y.

These amide components can be added to act as suds modifiers. They tend to boost the sudsing in an active system which exhibits relatively low sudsing and can depress the sudsing in systems which exhibit high sudsing.

The compositions of the present invention may also contain additional ingredients generally found in laundry detergent compositions, at their conventional art-established levels, as long as these ingredients are compatible with the components required herein. For example, the compositions can contain up to about 15%, preferably no more than about 5%, and most preferably from about 0.001 to about 2%, of one or more suds control components. Typical suds control agents useful in the compositions of the present invention include, but are not limited to, those described below.

Silicone suds control additives are described in U.S. Pat. No. 3,933,672, issued Jan. 20, 1976, Bartolotta et al, incorporated herein by reference. The silicone material can be represented by alkylated polysiloxane materials such as silica aerogels and xerogels and hydrophobic silicas of various types. The silicone material can be described as a siloxane having the formula:

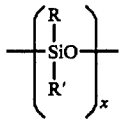

wherein x is from about 20 to about 2,000, and R and R′ are each alkyl or aryl groups, especially methyl, ethyl, propyl, butyl, and phenyl. Polydimethylsiloxanes (R and R′ are methyl) having a molecular weight within the range of from about 200 to about 200,000, and higher, are all useful as suds controlling agents. Additional suitable silicone matrials wherein the side chain groups R and R′ are alkyl, aryl, or mixed alkyl and aryl hydrocarbyl groups exhibit useful suds controlling properties. Examples of such ingredients include diethyl-, dipropyl-, dibutyl-, methyl-, ethyl-, phenylmethyl polysiloxanes and the like. Additional useful silicone suds control agents can be represented by a mixture of an alkylated siloxane, as referred to hereinbefore, and solid silica. Such mixtures are prepared by affixing the silicone to the surface of the solid silica. A preferred silicone suds control agent is represented by a hyrophobic silanated (most preferably timethyl silanated) silica having a particle size in the range from about 10 millimicrons to 20 millimicrons and a specific surface area above about 50 $m^2/gm$ intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially nonsurface-active, detergent-impermeable carrier.

Particularly useful suds control agents are the self-emulsifying silicone suds control agents described in U.S. Pat. No. 4,075,118, Gault et al, issued Feb. 21, 1978, incorporated herein by reference. An example of such a compound is DB-544, commercially available from Dow Corning, which contains a siloxane/glycol copolymer together with solid silica and a siloxane resin.

Microcrystalline waxes having a melting point in the range from 35° C.–115° C. and a saponification value of less than 100 represent additional examples of preferred suds control components for use in the subject compositions, and are described in detail in U.S. Pat. No. 4,056,481. Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 25° C., by ASTM-D1321. Suitable examples of the above waxes include: microcrystalline and oxidized microcrystalline petroleum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds control agent for use herein. These preferred phosphate esters are predominantly monostearyl phosphate which, in addition thereto, can contain di- and tristearyl phosphates and monooleyl phosphates, which can contain di- and trioleyl phosphates.

The alkyl phosphate esters frequently contain some trialkyl phosphate. Accordingly, a preferred phosphate ester can contain, in addition to the monoalkyl ester, e.g., monostearyl phosphate, up to about 50 mole percent of dialkyl phosphate and up to about 5 mole percent of trialkyl phosphate.

Other adjunct components which can be included in the compositions of the present invention include anionic, zwitterionic, ampholytic and cationic surfactants; bleaching agents; bleach activators; soil release agents (particularly copolymers of ethylene terephthalate and polyethylene oxide terephthalate, such as Milease T sold by ICI, United States, as disclosed in U.S. Pat. No. 4,132,680, Nicol, issued Jan. 2, 1979, incorporated herein by reference); soil suspending agents; corrosion inhibitors; dyes; fillers; optical brighteners; germicides; pH adjusting agents; alkalinity sources; enzymes; enzyme-stabilizing agents; perfumes, solvents such as ethyl alcohol; carriers; opacifiers; and the like. The required solution pH of from about 8 to about 13 can be obtained by the use of suitable alkaline matrials such as sodium hydroxide, sodium or potassium carbonate or bicarbonate, sodium or potassium silicates, and the alkanolamines. Particularly preferred is monoethanol amine.

Preferably, the composition contains an optical brightening or whitening agent.

Suitable optical brightening agents include:

(1) the reaction product of about one mole of ethylene oxide and one mole of 1,2-bis(benzimidazolyl) ethylene, e.g., N-(2'-hydroxyethyl)-1,2-bis(benzimidazolyl ethylene;

(2) tetrasodium 4,4'-bis[(4''-bis(2'''-hydroxyethy)-amino-6''-(3'''-sulfophenyl)amino-1'',3'',5''-triazin-2''-yl)amino]-2,2'-stilbenedisulfonate;

(3) N-(2-hydroxyethyl-4,4'-bis(benzimidazolyl)stilbene;

(4) disodium-4-[6'-sulfonaphthol(1',2'-d)triazol-2-yl]-2-stilbenesulfonate;

(5) disodium-4,4'-bis[6 methyl ethanolamine)-3-anilino-1,3,5-triazin-2''-yl]-2,2'-stilbenedisulfonate;

(6) disodium 4,4'-bis[(4''-(2'''-hydroxyethoxy)-6''-anilino-1'',3'',5''-triazin-2''-yl)amino]-2,2'-stilbenedisulfonate;

(7) 1,2-bis(5'-methyl-2'-benzoxazolyl)ethylene;

(8) 4-methyl-7-dimethylaminocoumarin;

(9) 2-styrylnaphth[1,2-d]oxazole;

(10) the reaction product of one mole of 4,4'-bis-(benzimidazolyl) stilbene with about 0.5 mole of ethylene oxide and 0.5 mole of propylene oxide; and

(11) mixtures thereof.

These optical whitening agents are used in a level of from about 0.03% to about 0.8% and preferably at a level of about 0.4% by weight.

Because of the outstanding performance characteristics of the present invention, surfactants additional to the essential components will not generally be necessary.

Examples of additional surfactant which can be used in the compositions of the present invention are found in U.S. Pat. No. 3,717,630, Booth, issued Feb. 20, 1973, incorporated herein by reference. However, these components should be used in an amount as to be certain that they will be compatible with the essential surfactant system.

All percentages, parts, and ratios used herein are by weight unless otherwise specified.

The following nonlimiting examples illustrate the compositions of the present invention.

EXAMPLES

| | I | II | III | IV | V |
|---|---|---|---|---|---|
| Sodium $C_{14-15}$ alkyl polyethoxy$_{2.25}$ sulfate | 2.9 | 2.9 | — | — | — |
| Sodium $C_{12-13}$ alkyl polyethoxy$_3$ sulfate | — | — | 2.9 | — | — |
| Monoethanolammonium $C_{12}$ alkyl benzene sulfonate | — | — | — | 2.6 | — |
| Oleic fatty acid | — | 0.4 | — | — | 1.6 |
| Coconut fatty acid | 0.5 | — | 0.5 | 0.5 | — |
| $C_{12-13}$ alcohol polyethoxylate$_{6.5}$ | 6.4 | 6.4 | 6.4 | 6.4 | 4.7 |
| $C_{12-16}$ alkyldimethyl amine oxide | 3.3 | 3.3 | 3.3 | 3.3 | 3.3 |
| Sodium nitrilotriacetate | 18.2 | 18.2 | 18.2 | 18.2 | 21.5 |
| Potassium toluene sulfonate | 9.0 | 9.0 | 9.5 | 11.5 | 9.0 |
| Monoethanolamine | 2.8 | 2.7 | 2.8 | 2.8 | 2.9 |
| Water and minors | | | Balance | | |
| Stability for one week at −1.1, 4.4, 10, 21.1 and 48.9° C. | OK* | OK | OK | OK | OK |
| Freeze at −17.8° C. followed by | | | | | |
| thawing at −1.1° C. | OK | OK | OK | heavy ppt | OK |
| thawing at 4.4° C. | OK | OK | OK | heavy ppt | white ppt |
| thawing at 10° C. | OK | OK | OK | heavy ppt | white ppt |
| thawing at 21.1° C. | OK | OK | OK | OK | OK |

*OK means remains as a single phase isotropic liquid.

The above compositions were prepared by mixing the ingredients to form single phase isotropic liquids. The compositions remained as single phase isotropic liquids during static testing for one week at the indicated temperatures. However, when quickly frozen, only the compositions of the present invention (i.e., Examples I, II, and III) returned to single phase isotropic liquids at all thawing temperatures tested.

When the level of sodium nitrilotriacetate in Examples I, II and III is reduced to about 15%, thereby providing compositions containing a total of about 27.6% by weight of the builder and surfactants herein, the compositions exhibit even greater stability in that they also return to single phase isotropic liquids after being slowly frozen over a period of several days and thawed.

Other compositions of the present invention are obtained when the sodium nitrilotriacetate in Examples I, II and III is replaced with 15% or 20% of sodium or potassium citrate or ethane 1-hydroxy-1,1-diphosphonate, or with a 1:1 ratio mixture of sodium citrate and potassium pyrophosphate.

What is claimed is:

1. A stable liquid detergent composition comprising:

(a) from about 3% to about 20% of an ethoxylated alcohol or ethoxylated alkyl phenol nonionic surfactant of the formula $R(OC_2H_4)_nOH$, wherein R is selected from the group consisting of aliphatic hydrocarbon radicals containing from about 8 to about 15 carbon atoms and alkyl phenyl radicals in which the alkyl group contains from about 8 to about 12 carbon atoms, n is from about 3 to about 9, and said nonionic surfactant has an HLB value of from about 10 to about 13;

(b) from about 2% to about 15% of an amine oxide surfactant having the formula

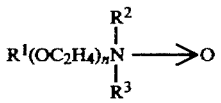

wherein $R^1$ is an alkyl, hydroxyalkyl, alkoxyhydroxypropyl, alkoxyhydroxyethyl, alkyl amido or alkyl carboxylate radical in which the alkyl and alkoxy portions contain from about 8 to about 18 carbon atoms, $R^2$ and $R^3$ are selected from the group consisting of methyl, ethyl, propyl, isopropyl, 2-hydroxyethyl, 2-hydroxypropyl, 3-hydroxypropyl, or said groups joined together to form a cyclic structure in which the nitrogen is part of a heterocyclic ring, and n is from 0 to about 10;

(c) from about 1% to about 10% of an alcohol polyethoxylate sulfate surfactant having the formula $R^4O(C_2H_4O)_mSO_3M$, wherein $R^4$ is an alkyl or hydroxyalkyl radical containing from about 10 to about 18 carbon atoms, m is from about 2 to about 10 and M is a compatible cation;

(d) from about 10% to about 20% of a water-soluble nitrilotriacelate or citrate detergency builder capable of sequestering calcium and magnesium ions in water solution; provided that components (a), (b), (c) and (d) together represent less than about 40% by weight of the composition;

(e) from 0% to about 25% of a hydrotrope;

(f) up to about 89% water; said liquid detergent composition being in isotropic form and having a pH of from about 8 to about 13 in a 0.2% water solution at 20° C.

2. The composition of claim 1 wherein, in the nonionic surfactant, R is a $C_{10-15}$ alkyl group and n is from about 3 to about 8.

3. The composition of claim 1 wherein the amine oxide surfactant is a $C_{12-16}$ alkyl dimethylamine oxide.

4. The composition of claim 1 wherein, in the alcohol polyethoxylate sulfate surfactant, m is from about 2 to about 3.

5. The composition of claim 1 wherein the water-soluble detergency builder is sodium or potassium nitrilotriacetate or citrate, or mixtures thereof.

6. The composition of claim 1 comprising from about 5% to about 10% of an ethoxylated alcohol nonionic surfactant of the formula $R(OC_2H_4)_nOH$ wherein R is a $C_{10-15}$ alkyl group and n is from about 3 to about 8, from about 3% to about 10% of a $C_{12-16}$ alkyl dimethylamine oxide, and from about 2% to about 6% of an alcohol polyethoxylate sulfate surfactant of the formula $R^4O(C_2H_4O)_mSO_3M$ wherein $R^4$ is a $C_{10-18}$ alkyl group, m is from about 2 to about 3 and M is sodium or potassium.

7. The composition of claim 6 wherein the nonionic, amine oxide and polyethoxylate sulfate surfactants and the builder together represent less than about 28% by weight of the composition.

8. The composition of claims 1 or 7 comprising from about 5% to about 16% of a hydrotrope selected from the group consisting of sodium and potassium toluene sulfonate, xylene sulfonate, cumene sulfonate, and mixtures thereof.

9. A stable liquid detergent composition comprising:

(a) from about 5% to about 10% of an ethoxylated alcohol or ethoxylated alkyl phenol nonionic surfactant of the formula $R(OC_2H_4)_nOH$, wherein R is selected from the group consisting of aliphatic hydrocarbon radicals containing from about 8 to about 15 carbon atoms and alkyl phenyl radicals in which the alkyl group contains from about 8 to about 12 carbon atoms, n is from about 3 to about 9, and said nonionic surfactant has an HLB value of from about 10 to about 13;

(b) from about 3% to about 10% of an amine oxide surfactant having the formula

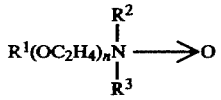

wherein $R^1$ is an alkyl, hydroxyalkyl, alkoxyhydroxypropyl, alkoxyhydroxyethyl, alkyl amido or alkyl carboxylate radical in which the alkyl and alkoxy portions contain from about 8 to about 18 carbon atoms, $R^2$ and $R^3$ are selected from the group consisting of methyl, ethyl, propyl, isopropyl, 2-hydroxyethyl, 2-hydroxypropyl, 3-hydroxypropyl, or said groups joined together to form a cyclic structure in which the nitrogen is part of a heterocyclic ring, and n is from 0 to about 10;

(c) from about 2% to about 6% of an alcohol polyethoxylate sulfate surfactant having the formula $R^4O(C_2H_4O)_mSO_3M$, wherein $R^4$ is an alkyl or hydroxyalkyl radical containing from about 10 to about 18 carbon atoms, m is from about 2 to about 10 and M is a compatible cation;

(d) from about 10% to about 20% of a water-soluble nitrilotriacetate; provided that components (a), (b), (c) and (d) together represent less than about 40% by weight of the composition;

(e) from 0% to about 25% of a hydrotrope;

(f) up to about 89% water; said liquid detergent composition being in isotropic form and having a pH of from about 8 to about 13 in a 0.2% water solution at 20° C.

10. The composition of claim 9 wherein, in the nonionic surfactant, R is a $C_{10-15}$ alkyl group and n is from about 3 to about 8.

11. The composition of claim 9 wherein the amine oxide surfactant is a $C_{12-16}$ alkyl dimethylamine oxide.

12. The composition of claim 9 wherein, in the alcohol polyethoxylate sulfate surfactant, m is from about 2 to about 3.

13. The composition of claim 12 wherein the nonionic, amine oxide and polyethoxylate sulfate surfactants and the nitrilotriacetate together represent less than about 28% by weight of the composition.

14. The composition of claims 9 comprising from about 5% to about 16% of a hydrotrope selected from the group consisting of sodium and potassium toluene sulfonate, xylene sulfonate, cumene sulfonate, and mixtures thereof.

15. The composition of claims 13 comprising from about 5% to about 16% of a hydrotrope selected from the group consisting of sodium and potassium toluene sulfonate, xylene sulfonate, cumene sulfonate, and mixtures thereof.

* * * * *